US011679294B2

(12) United States Patent
Stinton et al.

(10) Patent No.: US 11,679,294 B2
(45) Date of Patent: Jun. 20, 2023

(54) DEVICE FOR ASSISTING WITH EXTENSION AND/OR FLEXION

(71) Applicant: ERMI LLC, Atlanta, GA (US)

(72) Inventors: Shaun Kevin Stinton, Chamblee, GA (US); Thomas P. Branch, Atlanta, GA (US); Edward S. Dittmar, Atlanta, GA (US); Matei Dan, Salt Lake City, UT (US)

(73) Assignee: ERMI LLC, Atlanta, GA (US)

( * ) Notice: Subject to any disclaimer, the term of this patent is extended or adjusted under 35 U.S.C. 154(b) by 0 days.

(21) Appl. No.: 17/071,829

(22) Filed: Oct. 15, 2020

(65) Prior Publication Data

US 2021/0113878 A1 Apr. 22, 2021

Related U.S. Application Data

(60) Provisional application No. 62/915,892, filed on Oct. 16, 2019.

(51) Int. Cl.
*A63B 21/00* (2006.01)
*A63B 21/008* (2006.01)
(Continued)

(52) U.S. Cl.
CPC .... *A63B 21/00185* (2013.01); *A63B 21/0083* (2013.01); *A63B 21/4034* (2015.10);
(Continued)

(58) Field of Classification Search
CPC ..... A63B 21/00185; A63B 21/008; A63B 21/0083; A63B 21/0085; A63B 21/16;
(Continued)

(56) References Cited

U.S. PATENT DOCUMENTS 3,000,632 A * 9/1961 Fuchs ..... A63B 21/4035 601/24
4,474,176 A * 10/1984 Farris ..... A61H 1/0266 601/34

(Continued)

FOREIGN PATENT DOCUMENTS

DE 29801776 U1 * 4/1998 ..... A63B 21/0004

OTHER PUBLICATIONS

Patent Cooperation Treaty Office; International Search Report and Written Opinion dated Mar. 1, 2021 cited in PCT/US2020/055823; 9 pages.

*Primary Examiner* — Joshua Lee
(74) *Attorney, Agent, or Firm* — Shumaker, Loop & Kendrick, LLP; Patrick B. Horne

(57) ABSTRACT

Embodiments of the invention are directed to devices and methods for providing extension and flexion assistance. A device manipulates a foot of a user, thereby providing extension or flexion assistance to an ankle of the user, and includes a footplate positioned at a pre-determined distance from the user and adapted to pivot about an axis defined by the ankle as the foot extends or flexes about the ankle; and a force application system comprising a force applicator connected to the footplate, and a force application mechanism, wherein the force application mechanism is configured to apply a force to the force applicator, thereby providing the extension or flexion assistance to the foot about the ankle.

19 Claims, 19 Drawing Sheets

(51) Int. Cl.

| | |
|---|---|
| ***A63B 23/035*** | (2006.01) |
| ***A63B 23/10*** | (2006.01) |
| *A63B 21/16* | (2006.01) |
| *A63B 23/08* | (2006.01) |

(52) U.S. Cl.
CPC ..... *A63B 21/4035* (2015.10); *A63B 21/4039* (2015.10); *A63B 23/03508* (2013.01); *A63B 23/10* (2013.01); *A63B 21/1609* (2015.10); *A63B 21/4047* (2015.10); *A63B 23/08* (2013.01); *A63B 2208/0233* (2013.01); *A63B 2210/50* (2013.01); *A63B 2225/09* (2013.01); *A63B 2225/62* (2013.01)

(58) Field of Classification Search
CPC ..... A63B 21/1609; A63B 21/4011; A63B 21/4013; A63B 21/4015; A63B 21/4033; A63B 21/4034; A63B 21/4035; A63B 21/4039; A63B 21/4047; A63B 23/03508; A63B 23/04; A63B 23/0405; A63B 23/0494; A63B 23/08; A63B 23/10; A63B 2208/0233; A63B 2210/02; A63B 2210/50; A63B 2225/09; A63B 2225/62; A61H 1/00; A61H 1/02; A61H 1/0237; A61H 1/0266; A61H 2201/0107; A61H 2201/0157; A61H 2201/1238; A61H 2201/1253; A61H 2201/1269; A61H 2201/1276; A61H 2201/1409; A61H 2205/10; A61H 2205/102; A61H 2205/106; A61H 2205/108; A61H 2205/12
See application file for complete search history.

(56) References Cited

U.S. PATENT DOCUMENTS

| | | | | |
|---|---|---|---|---|
| 4,566,440 | A * | 1/1986 | Berner | A63B 21/00178 601/34 |
| 4,637,379 | A * | 1/1987 | Saringer | A61H 1/0259 601/34 |
| 4,834,073 | A * | 5/1989 | Bledsoe | A61H 1/0259 601/34 |
| 5,239,987 | A * | 8/1993 | Kaiser | A61H 1/0259 601/34 |
| 6,821,231 | B1 | 11/2004 | Hall | |
| 2003/0120186 | A1* | 6/2003 | Branch | A61H 1/0259 601/5 |
| 2009/0137369 | A1* | 5/2009 | Branch | A61H 1/0259 602/32 |
| 2012/0022412 | A1* | 1/2012 | Bryant | A61H 1/0266 601/24 |
| 2012/0046540 | A1* | 2/2012 | Branch | A61B 5/459 600/407 |
| 2014/0031728 | A1* | 1/2014 | Guillen | A61H 1/00 601/34 |

* cited by examiner

DEVICE FOR ASSISTING WITH EXTENSION AND/OR FLEXION

CROSS-REFERENCE TO RELATED APPLICATIONS

This application is a non-provisional application tracing priority and claiming benefit to U.S. Provisional Application No. 62/915,892, filed Oct. 16, 2019, entitled "A DEVICE FOR ASSISTING WITH EXTENSION AND/OR FLEXION", the entirety of which is expressly incorporated herein by reference.

FIELD OF THE INVENTION

The present invention is generally directed to orthotic devices and more particularly to orthotic devices designed to improve and promote gains in range of motion in a joint by use of hydraulic systems and/or mechanical lever systems.

BACKGROUND

When a joint is damaged either from an injury event or through surgical intervention, scar tissue may form and limit the motion of the joint. This loss of motion can greatly affect a person's quality of life by limiting their ability to accomplish their normal activities of daily living. Traditionally, orthotics are separated into two categories: those that support and protect limbs and those that attempt to return range of motion to the joint by application of force.

Different joints are capable of moving in different directions, and the full range of motion of a joint depends upon the anatomy of that joint and on the particular genetics of each individual. Joint motion can generally be classified as linear or rotational. For example, linear joint motions include flexion and extension where flexion is defined as a bending of the joint and extension is often defined as a straightening of the joint. Rotational motions include proration and supination, which is where the hand rotates around the longitudinal axis of the forearm placing the palm up or the palm down.

Conventional orthotic devices have attempted to provide support across a joint, traditionally utilizing a rigid member or hinged joint. Orthotics aim to protect the joint by supporting the joint.

Some devices use a hinge system to apply a low load force on the joint by tightening a spring and thus stretching accumulated scar tissue over a long period of time. Some use a cuff for each limb segment and are uncomfortable and must be worn for hours at a time to be effective.

BRIEF SUMMARY

The following presents a summary of certain embodiments of the invention. This summary is not intended to identify key or critical elements of all embodiments nor delineate the scope of any or all embodiments. Its sole purpose is to present certain concepts and elements of one or more embodiments in a summary form as a prelude to the more detailed description that follows.

Embodiments of the present invention address the above needs and/or achieve other advantages by providing a device for manipulating a foot of a user, thereby providing extension or flexion assistance to an ankle of the user, the device comprising a footplate positioned at a pre-determined distance from the user and adapted to pivot about an axis defined by the ankle as the foot extends or flexes about the ankle; and a force application system comprising a force applicator connected to the footplate, and a force application mechanism, wherein the force application mechanism is configured to apply a force to the force applicator, thereby providing the extension or flexion assistance to the foot about the ankle.

According to embodiments of the invention, a device for manipulating a foot of a user, thereby providing extension or flexion assistance to an ankle of the user comprises a foot engagement assembly comprising a frame positioned at a pre-determined distance from the user, and a footplate connected to the frame and configured to pivot about an axis defined by the ankle as the foot extends or flexes about the ankle; and a force application system comprising a force applicator connected to the foot engagement assembly, and a force application mechanism, wherein the force application mechanism is configured to apply a force to the force applicator, thereby providing the extension or flexion assistance to the foot about the ankle.

In some embodiments, the force application mechanism is a hydraulic cylinder.

In some embodiments, the device according to claim 2, wherein the force application mechanism is a mechanical driven system.

In some embodiments, a power unit is configured to provide power to the force application mechanism. In some such embodiments, the power unit is a hydraulic cylinder. In other such embodiments, the power unit includes a lever adapted to move about a fulcrum; a hand grip positioned on an end of the lever opposite the fulcrum; and whereby when the hand grip is moved by the user, the lever rotates about the fulcrum to generate power.

In some embodiments, the force application mechanism is powered by a hand pump adapted for use by an arm of the user.

In some embodiments, the footplate is adapted to adjust to a pre-determined distance from the user.

In some embodiments, the device also includes a knee engagement assembly adapted to engage an anterior of the user's knee or lower thigh and secure the user's foot on the footplate during extension or flexion assistance. In some such embodiments, the knee support has a padded portion for engaging the user's knee mounted on a telescoping member adapted to adjust for secured engagement of the user's knee.

In some embodiments, the device includes a switch connected to the force application system and adapted to alternate the force application system between providing flexion and extension assistance.

In some embodiments, the footplate is connected to a frame extending from an underside of a chair. In some such embodiments, the knee support is connected to the frame.

In some such embodiments, the force application system is connected to the frame.

In some embodiments, the device also includes an adjustment frame extending from an underside of a chair. In some such embodiments, the footplate, knee support, and force application system are all adjustably connected to the frame.

In some embodiments, the device includes an inflatable member positioned above the footplate and adapted to secure the user's foot to the footplate when the inflatable member is inflated.

In some embodiments, the device includes a knee support adapted to engage a posterior of the user's knee or lower thigh and maintain knee positioning during extension or flexion assistance.

According to embodiments of the invention, a device for manipulating a foot of a user, thereby providing extension or flexion assistance to an ankle of the user includes a foot engagement assembly comprising a frame positioned at a pre-determined distance from the user, and a footplate connected to the frame and configured to pivot about an axis defined by the ankle as the foot extends or flexes about the ankle; a knee engagement assembly adapted to engage the user's knee and secure the user's foot on the footplate during extension or flexion; and a force application system comprising a force applicator connected to the foot engagement assembly, and a force application mechanism, wherein the force application mechanism is configured to apply a force to the force applicator, thereby providing the extension or flexion assistance to the foot about the ankle. In some such embodiments, an adjustment rail adapted to enable the foot engagement assembly, knee engagement assembly, and force application system to adjust to pre-determined distances from the user's position.

According to embodiments of the invention, a method for manipulating a user's foot, thereby providing extension or flexion assistance to an ankle of the user, includes engaging the foot of the user with a footplate configured to pivot about an axis defined by the ankle as the foot extends or flexes about the ankle; and activating a force application mechanism to apply an incremental force to a first end of a force applicator, wherein a second end of the force applicator is operatively coupled to the footplate, and wherein the applied incremental force causes a length between the first end of the force applicator and the second end of the force applicator to shorten, thereby causing extension or flexion of the footplate and the ankle of the user.

In some embodiments, the step of activating the force application mechanism further comprises the step of the user moving a lever on a power unit which provides power to the force application mechanism.

The features, functions, and advantages that have been discussed may be achieved independently in various embodiments of the present invention or may be combined with yet other embodiments, further details of which can be seen with reference to the following description and drawings.

BRIEF DESCRIPTION OF THE DRAWINGS

Figure 1:
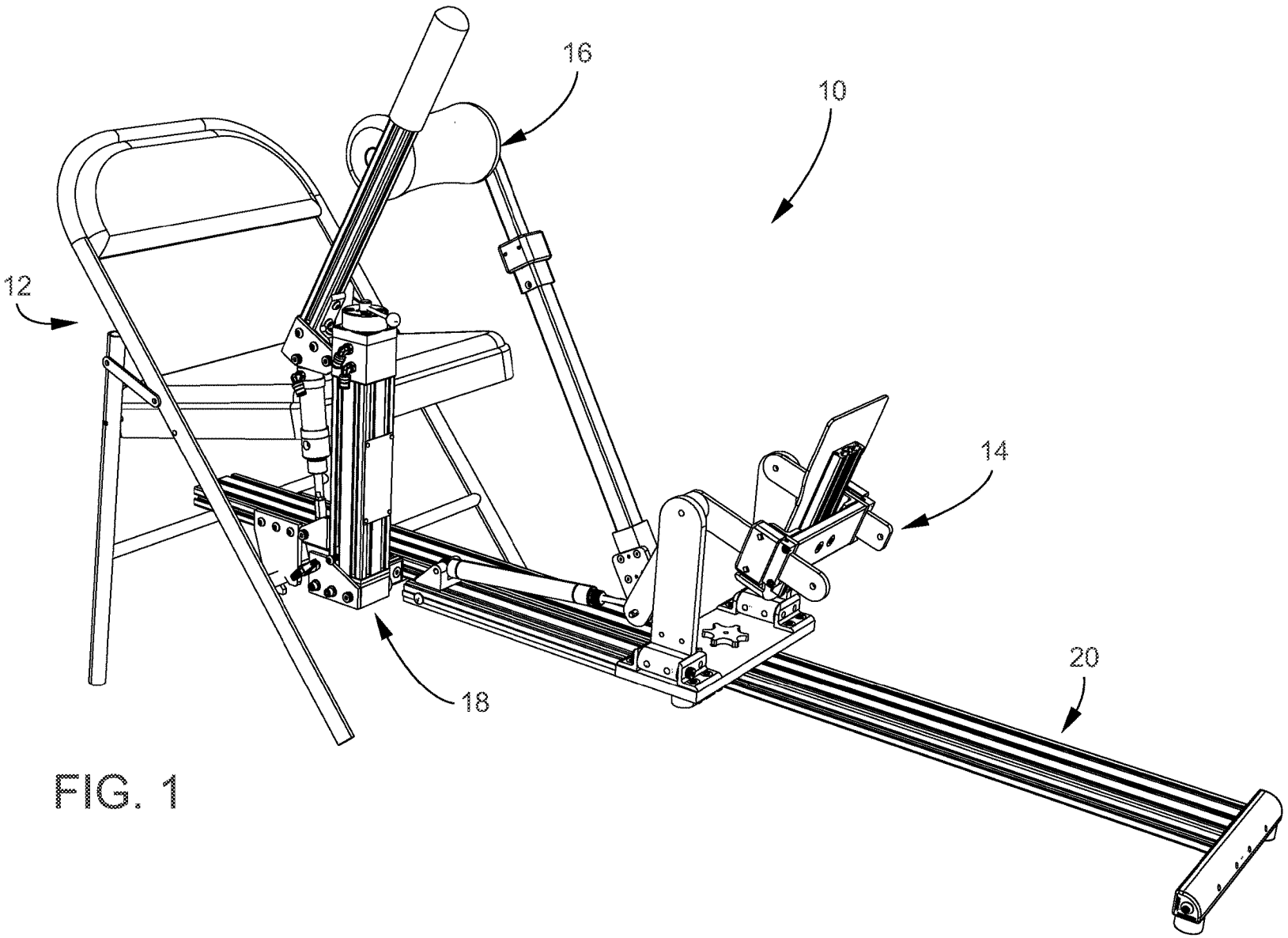
Figures 2A, 2B:
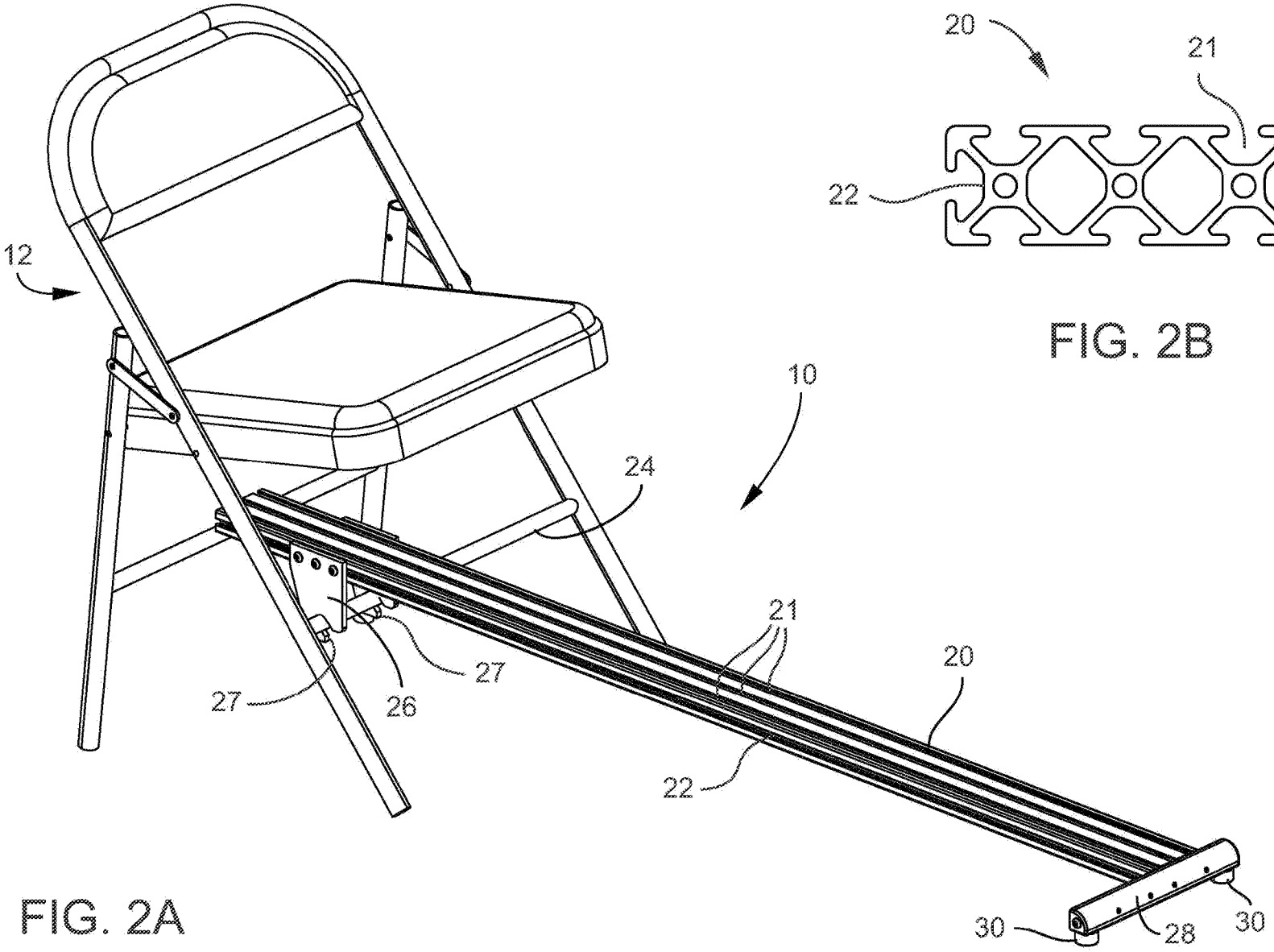
Figure 3:
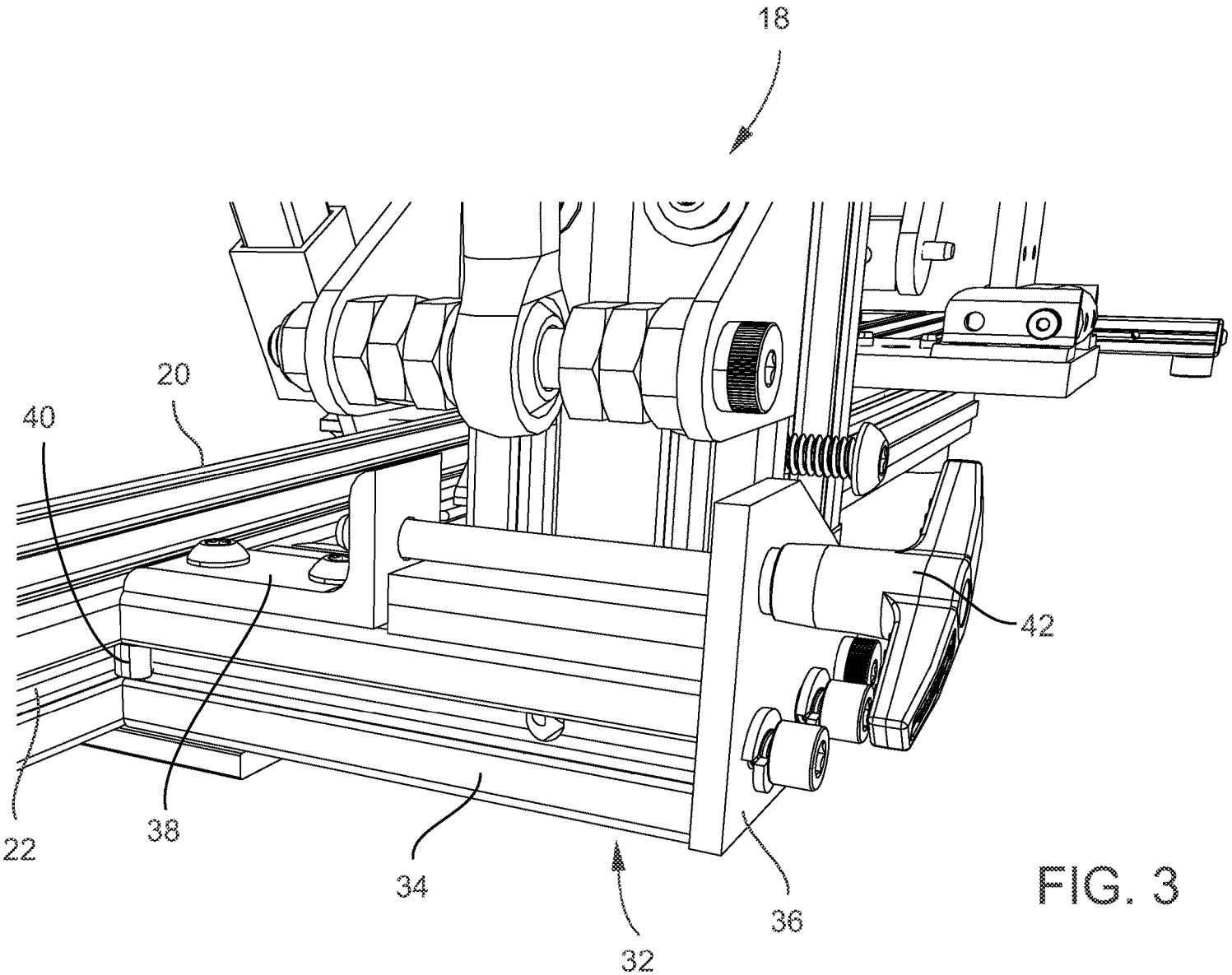
Figure 4A:
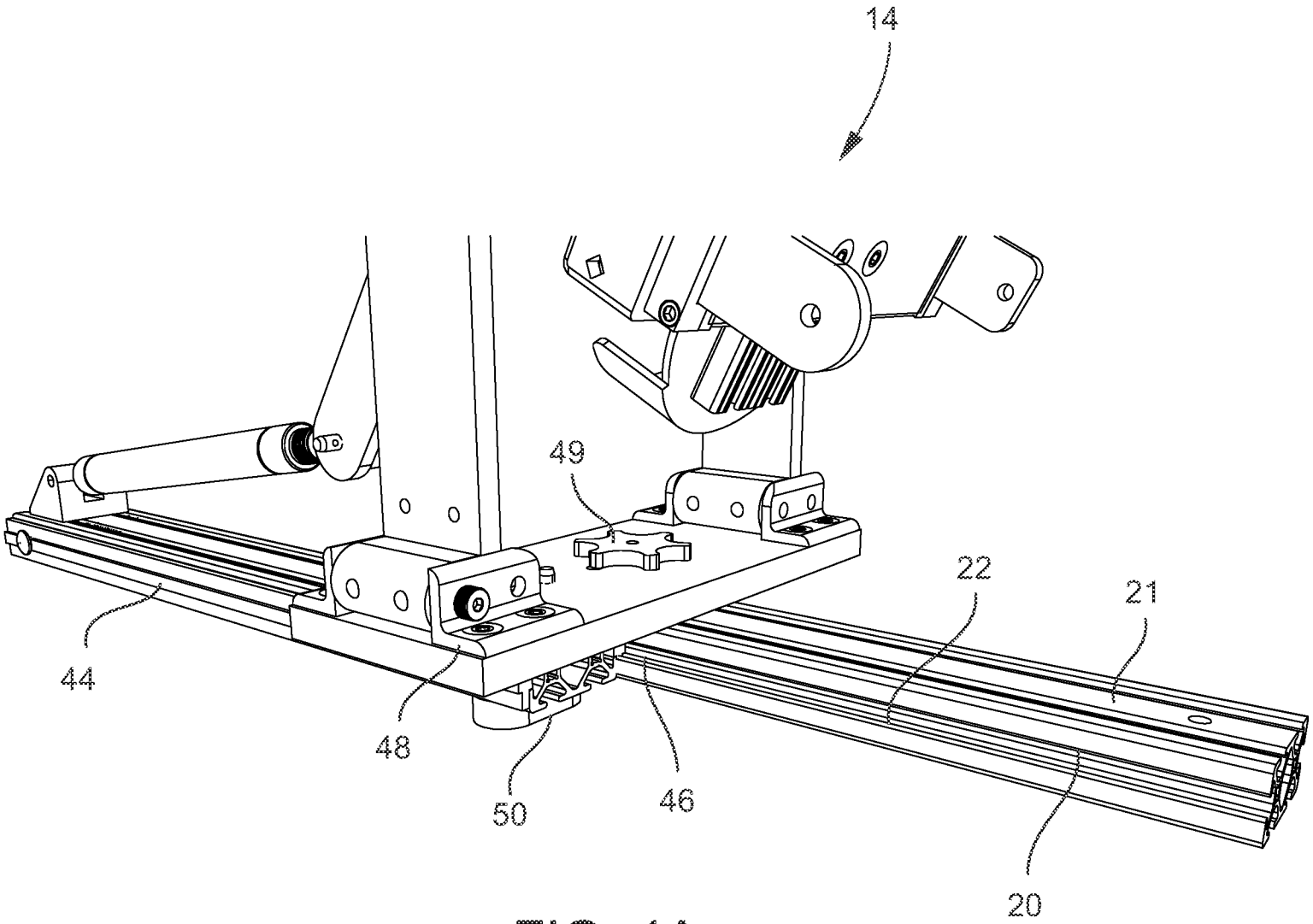
Figure 4B:
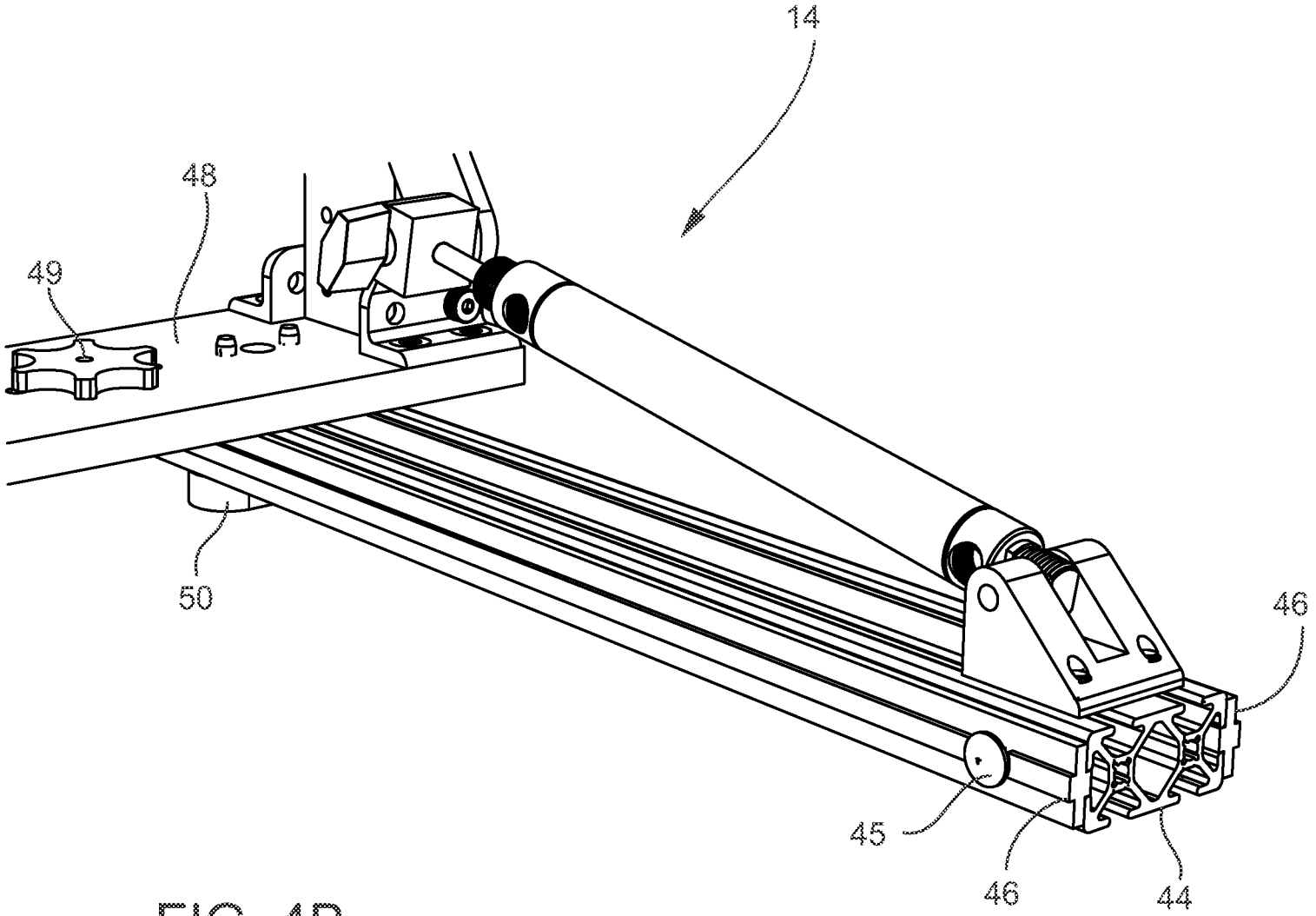
Figure 5A:
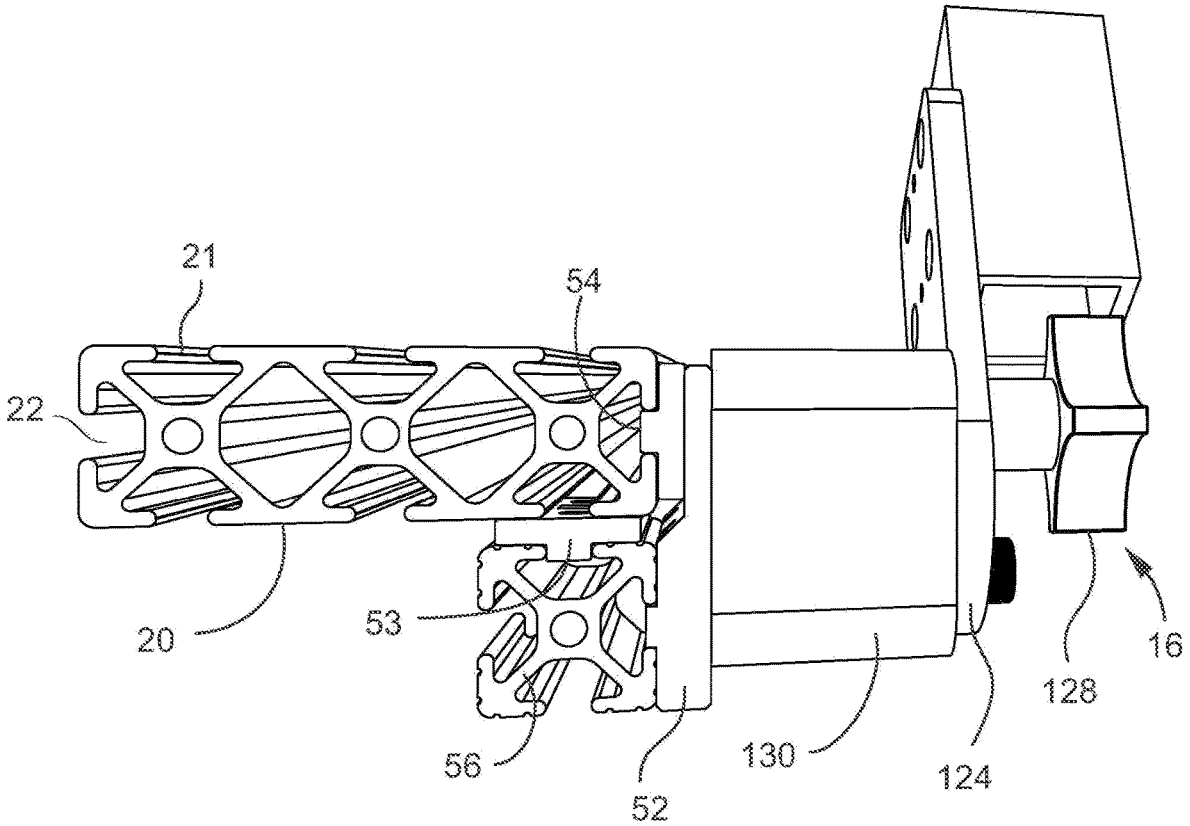
Figure 5B:
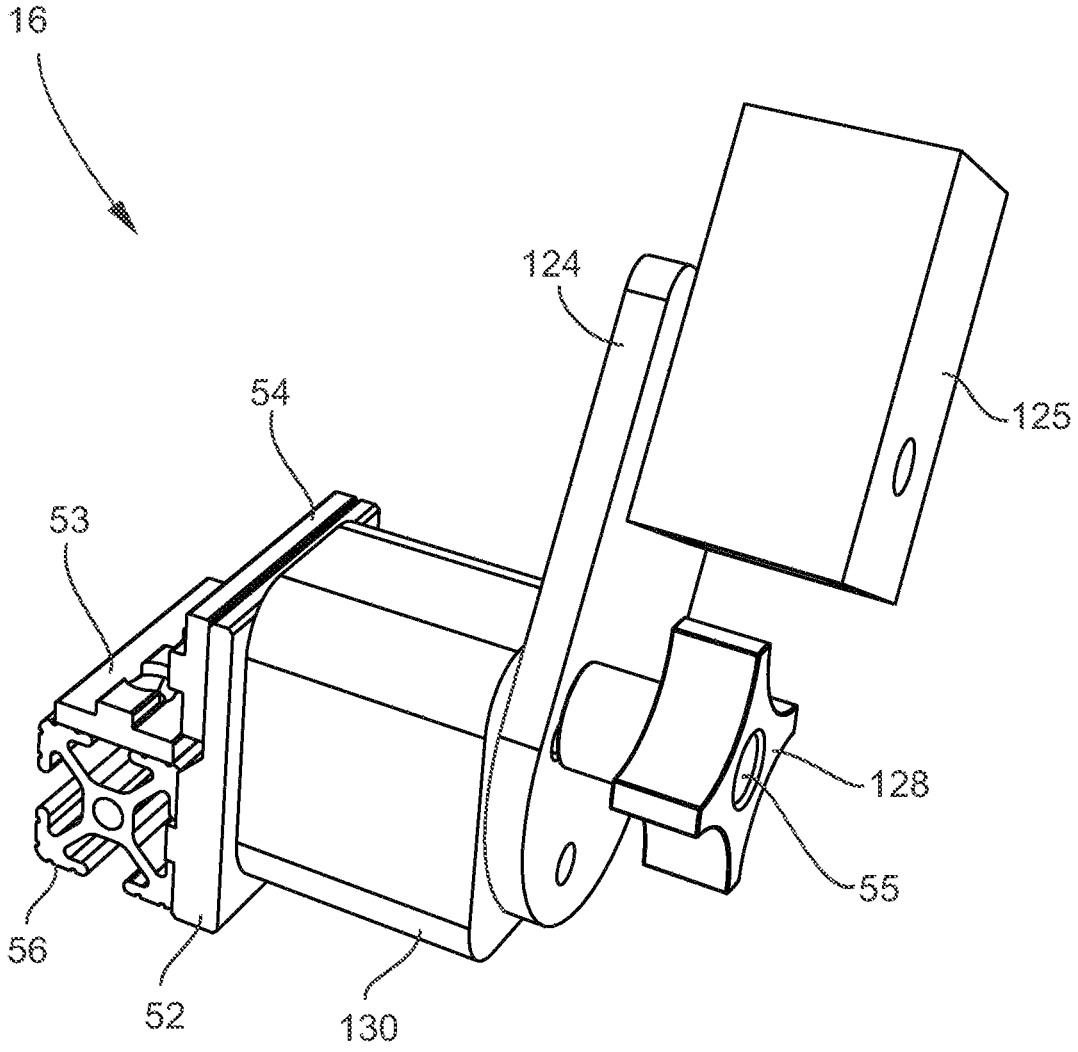
Figure 6:
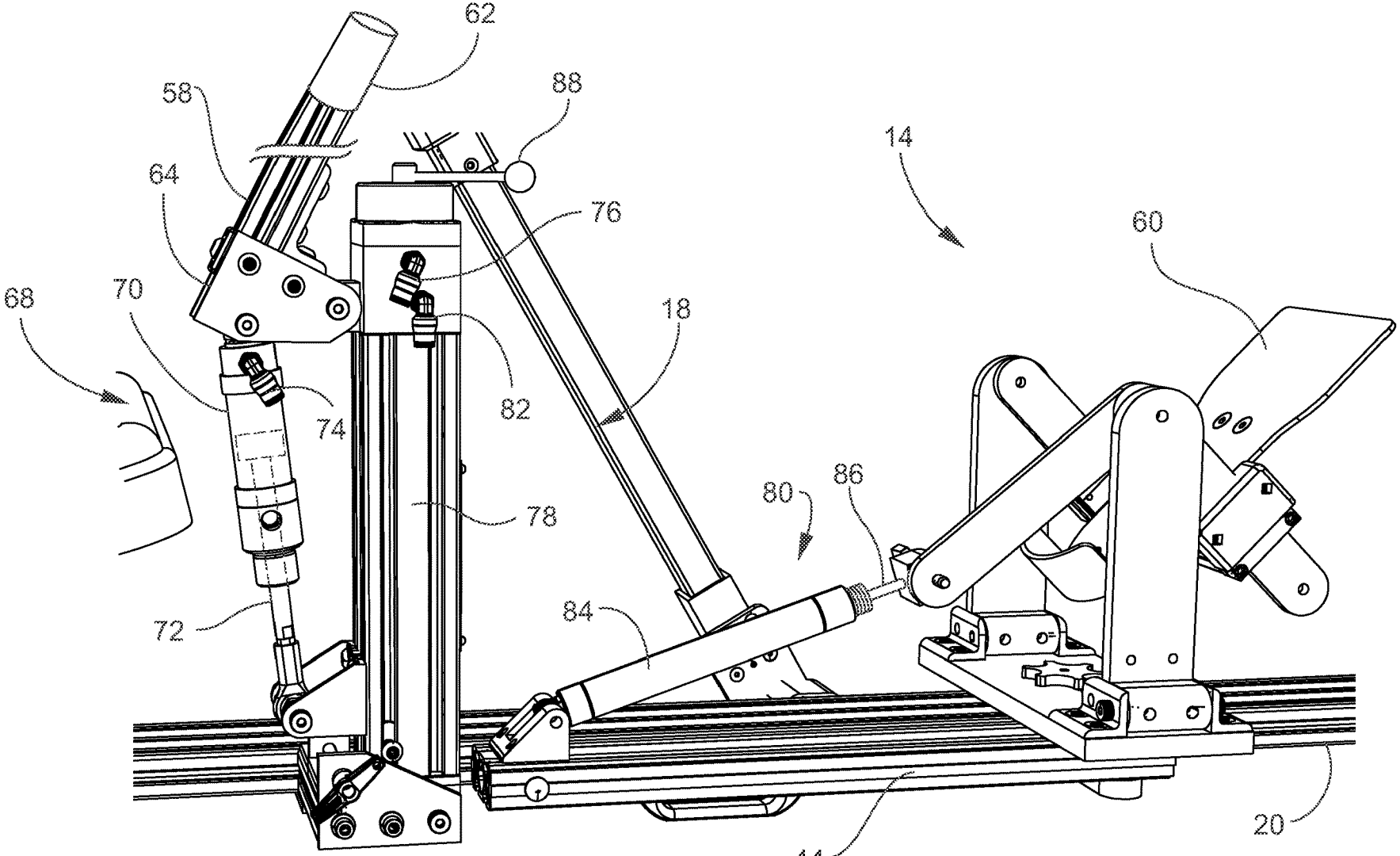
Figure 7:
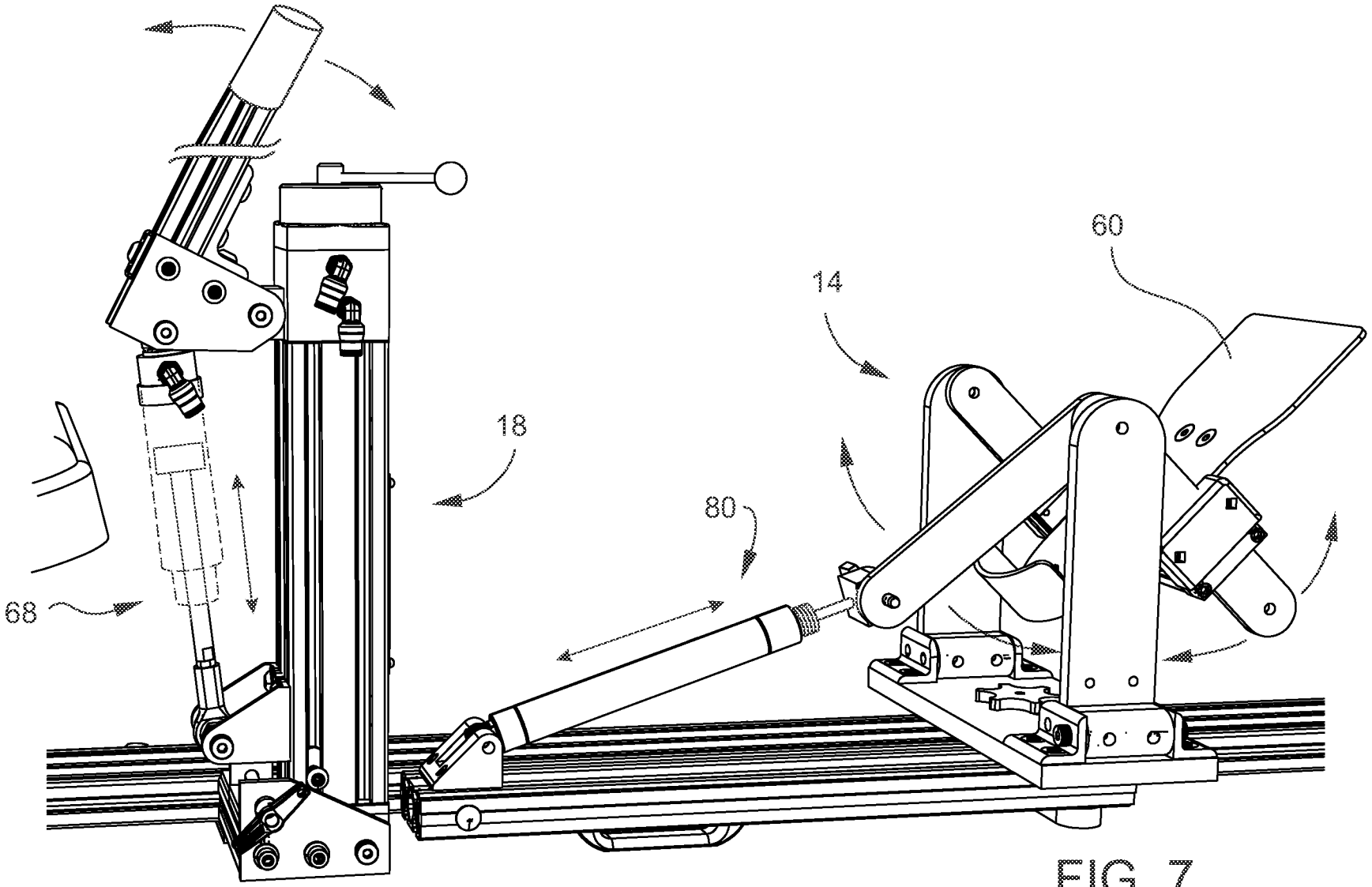
Figure 8:
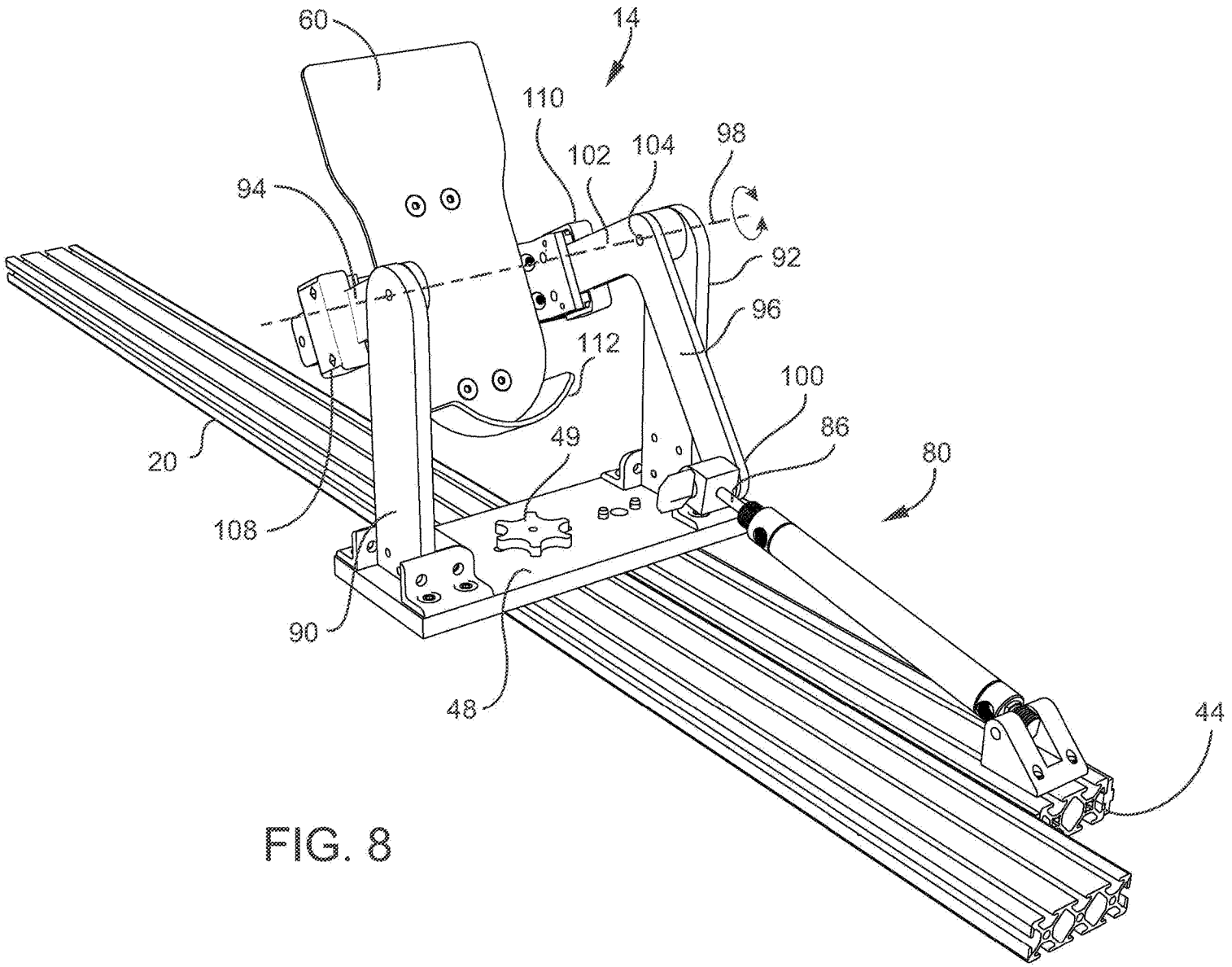
Figure 9:
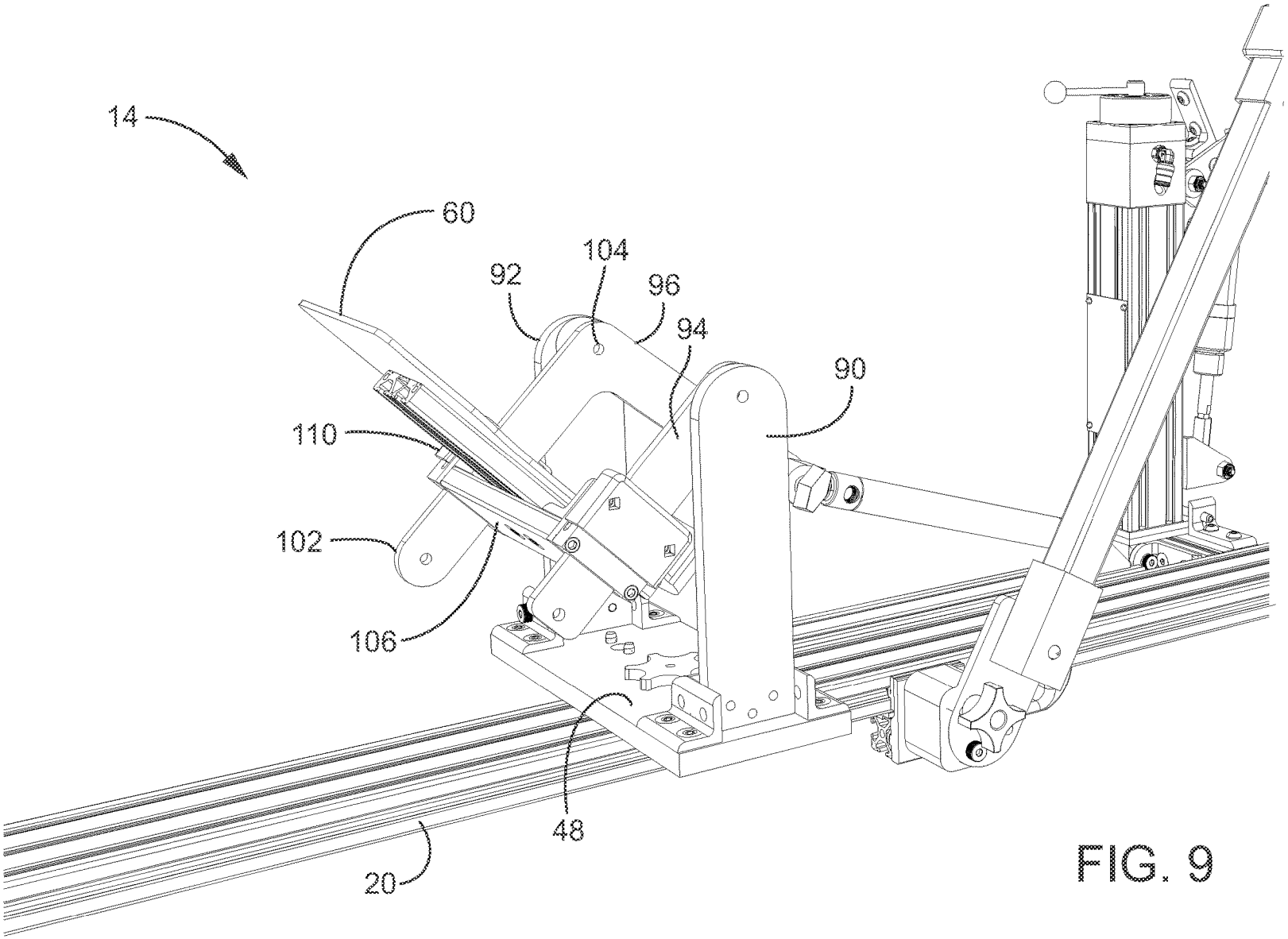
Figure 10:
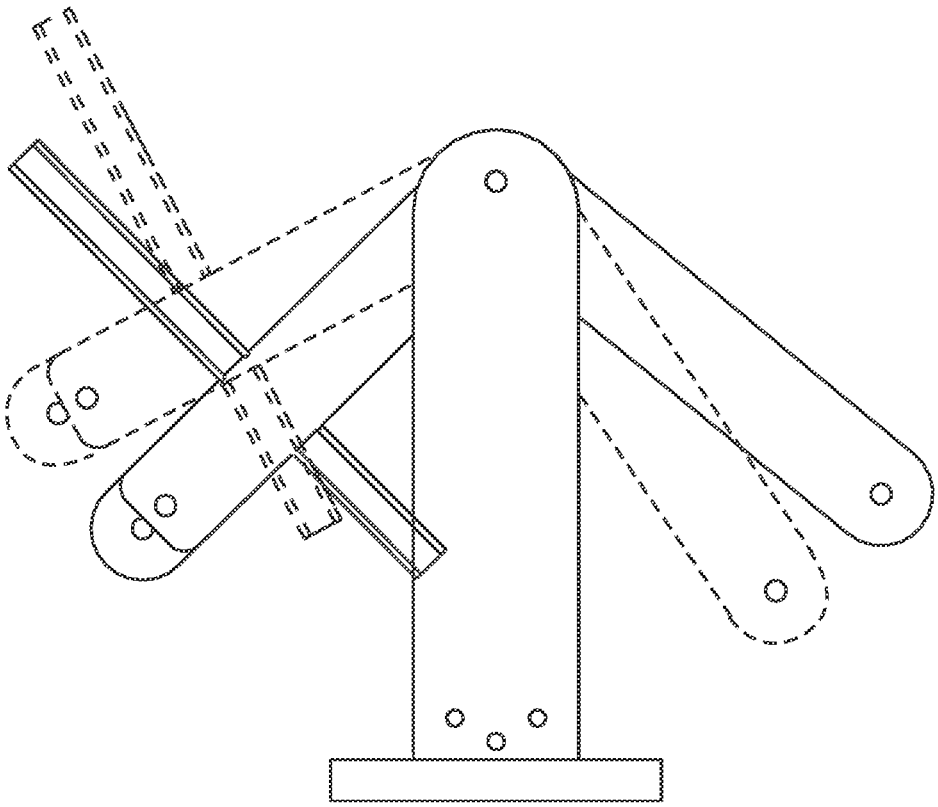
Figure 11:
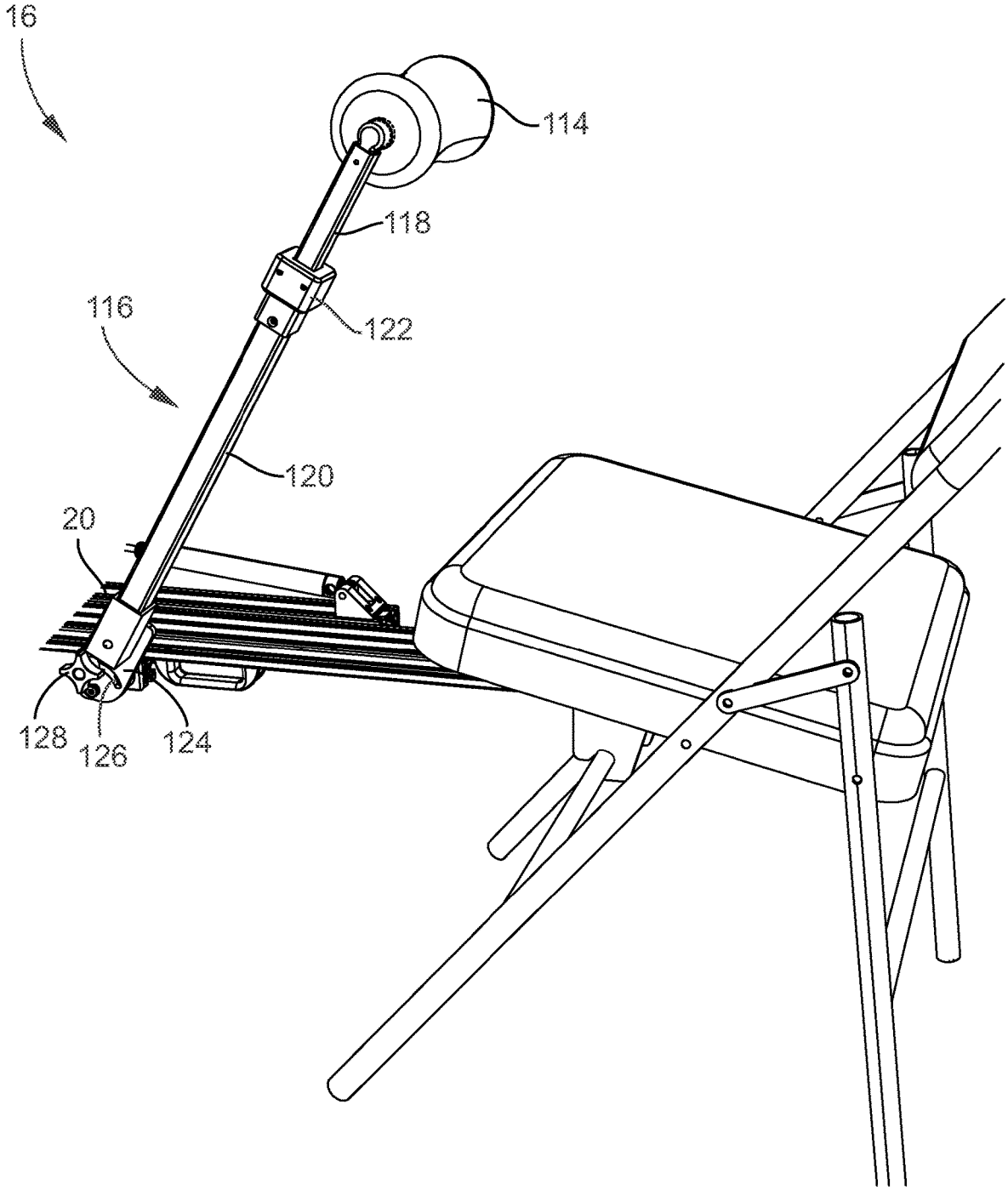
Figure 12:
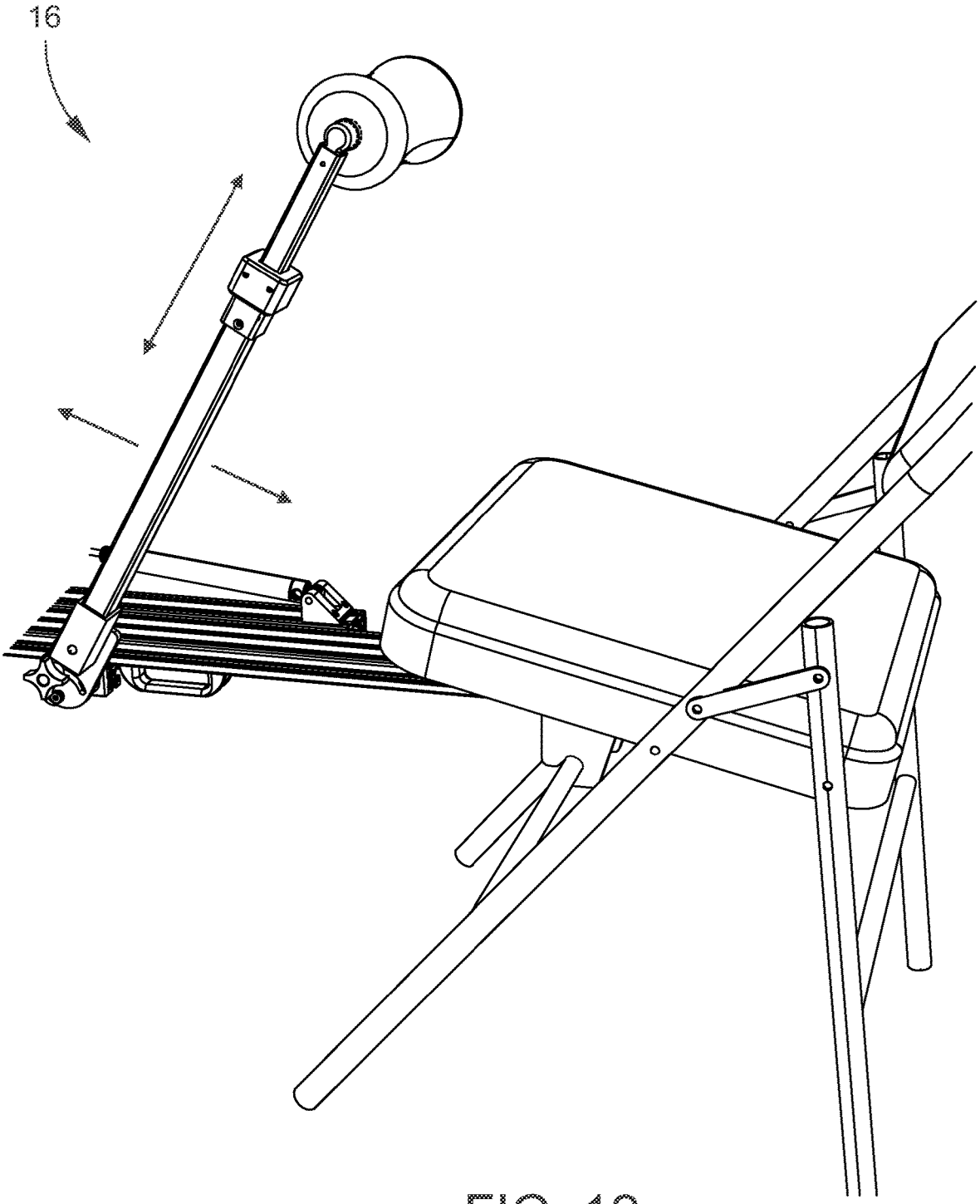
Figure 13:
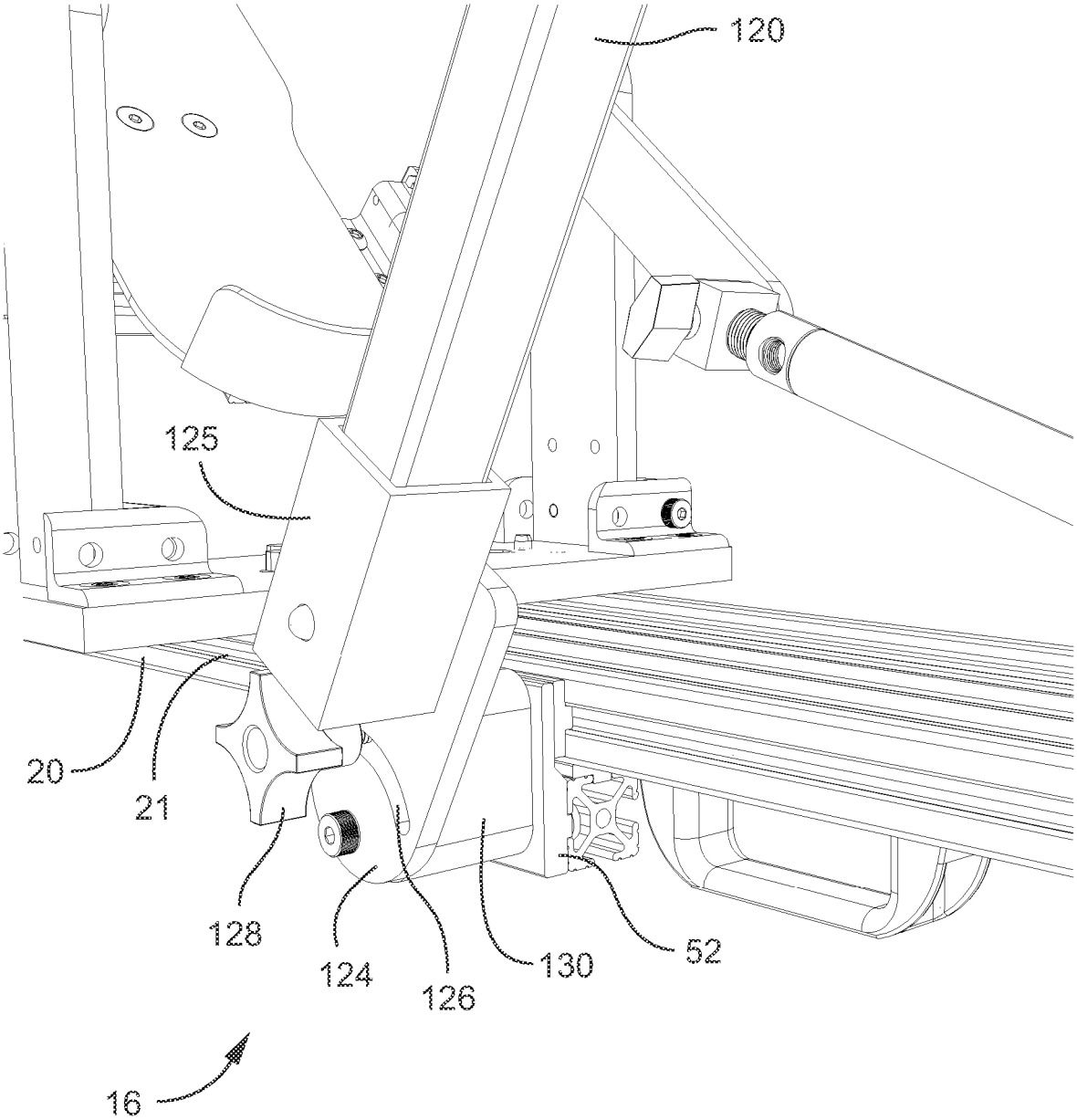
Figure 14:
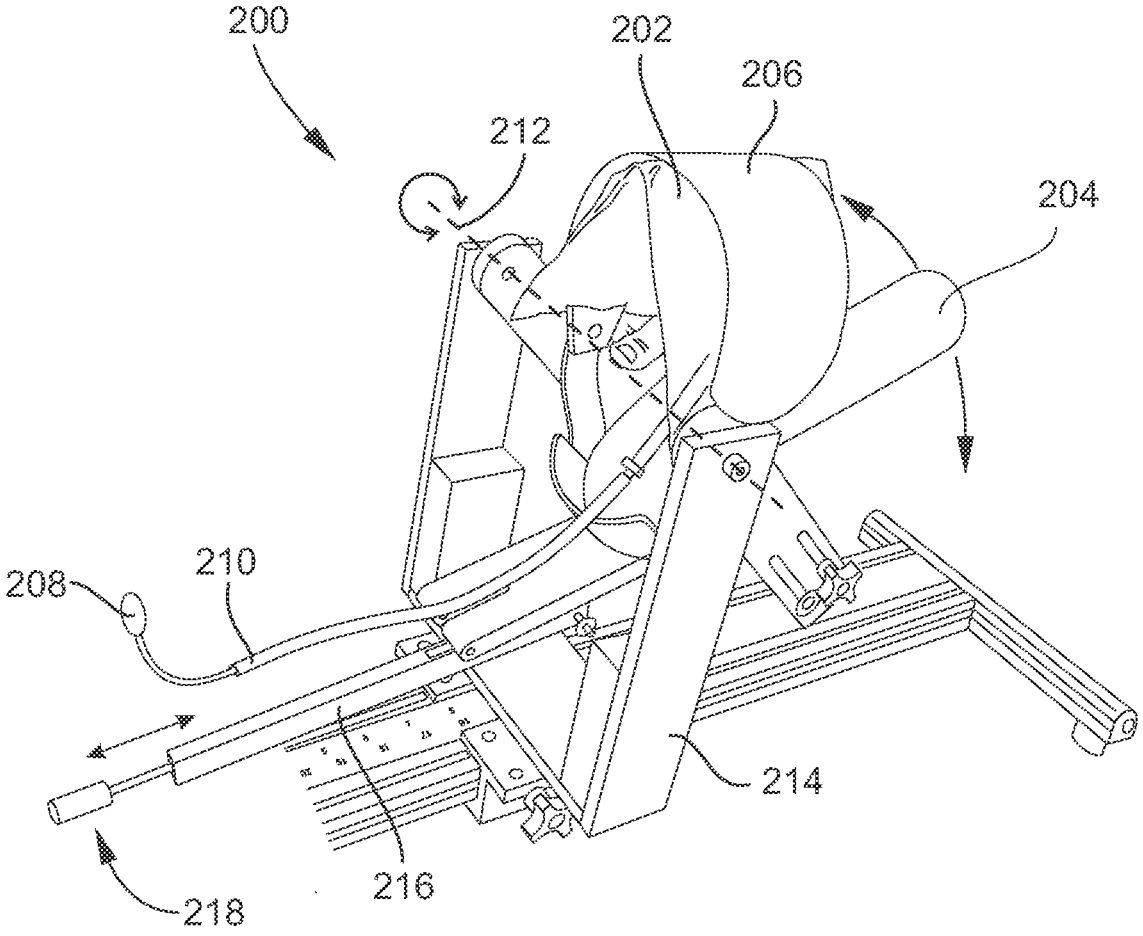
Figure 15:
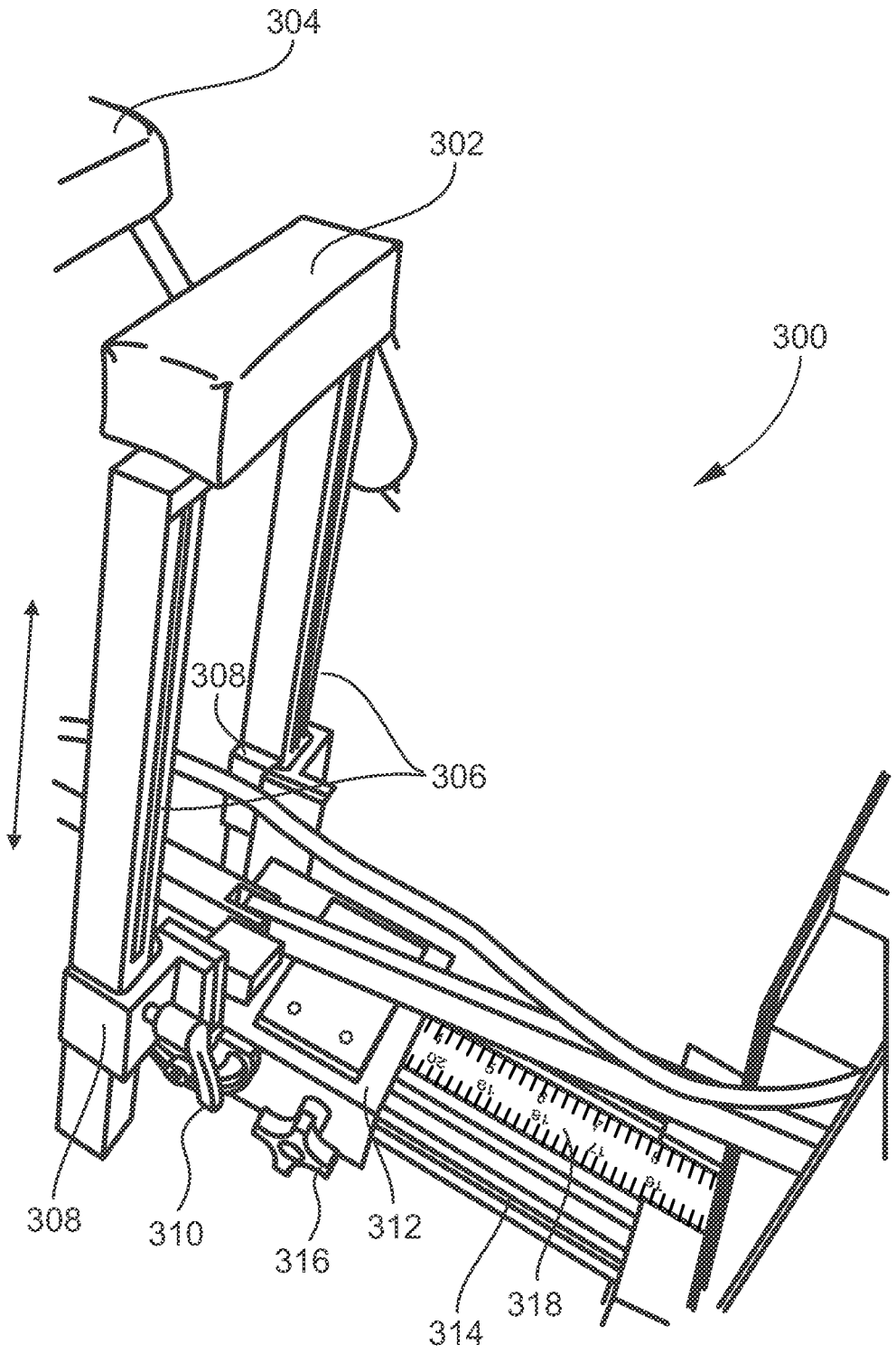
Figure 16:
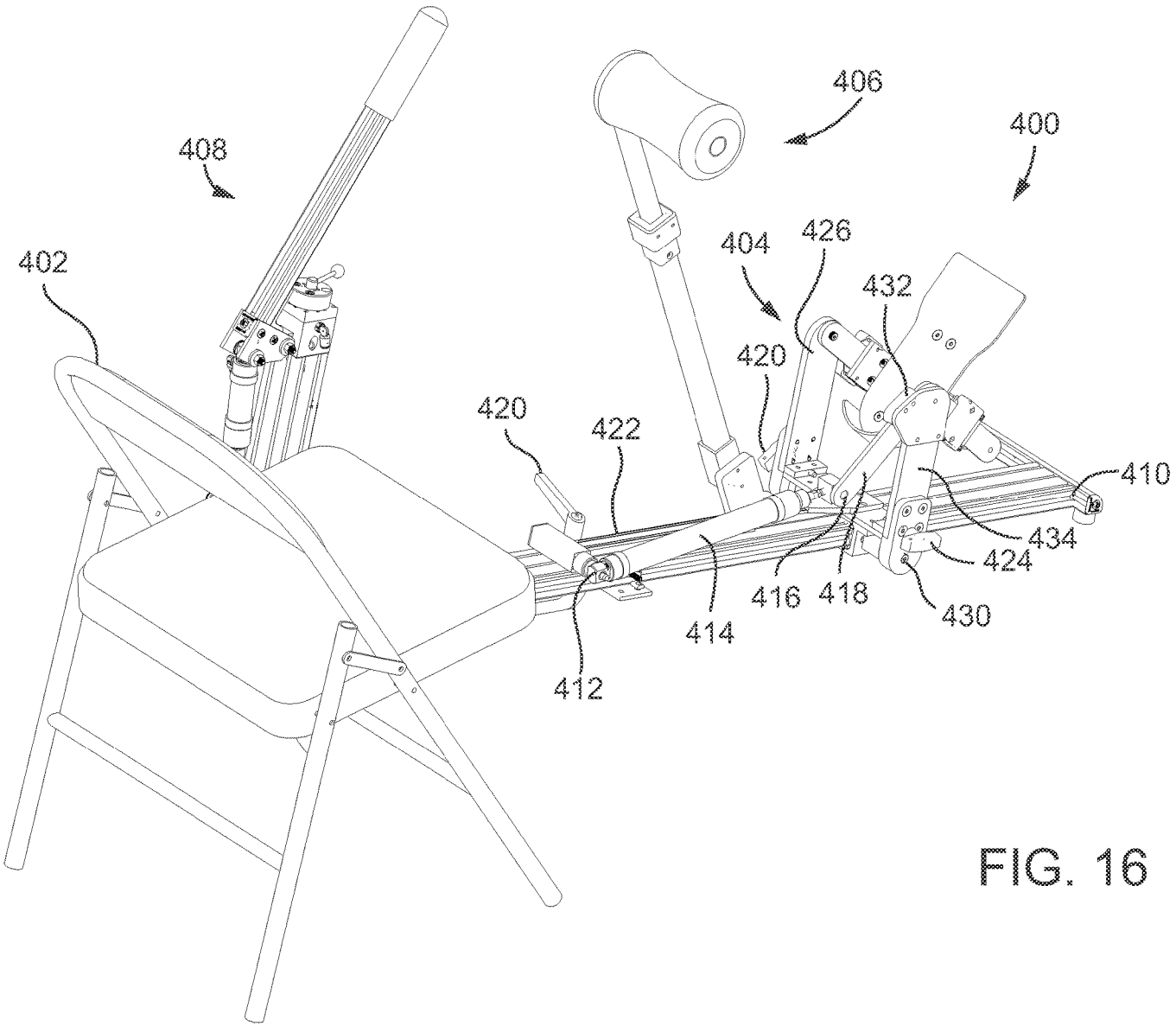
Figure 17:
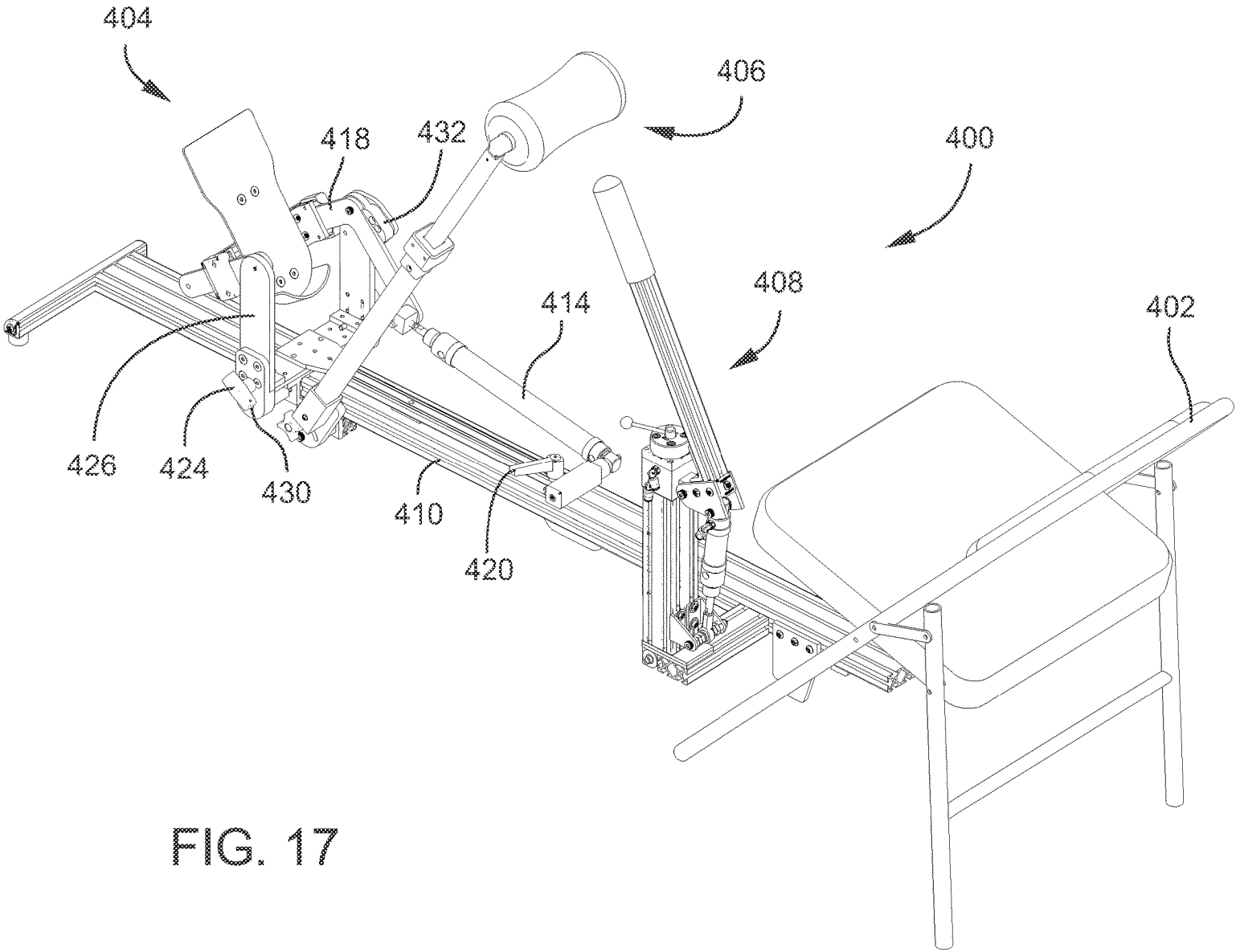

Having thus described embodiments of the invention in general terms, reference will now be made the accompanying drawings, wherein:

FIG. 1 provides a perspective view of one embodiment of a device for assisting with extension and/or flexion;

FIG. 2A provides a partial perspective view of one embodiment of a device for assisting with extension and/or flexion, in accordance with embodiments of the invention;

FIG. 2B provides a cross-sectional view of a component of the device for assisting with extension and/or flexion of FIG. 2A;

FIG. 3 provides a partial perspective view of one embodiment of a device for assisting with extension and/or flexion, in accordance with embodiments of the invention;

FIG. 4A provides a partial perspective view of one embodiment of a device for assisting with extension and/or flexion, in accordance with embodiments of the invention;

FIG. 4B provides a partial perspective view of one embodiment of a device for assisting with extension and/or flexion, in accordance with embodiments of the invention;

FIG. 5A provides a partial perspective view of one embodiment of a device for assisting with extension and/or flexion, in accordance with embodiments of the invention;

FIG. 5B provides a partial perspective view of one embodiment of a device for assisting with extension and/or flexion, in accordance with embodiments of the invention;

FIG. 6 provides a partial perspective view of one embodiment of a device for assisting with extension and/or flexion, in accordance with embodiments of the invention;

FIG. 7 provides a partial perspective view of one embodiment of a device for assisting with extension and/or flexion, in accordance with embodiments of the invention;

FIG. 8 provides a partial perspective view of one embodiment of a device for assisting with extension and/or flexion, in accordance with embodiments of the invention;

FIG. 9 provides a partial perspective view of one embodiment of a device for assisting with extension and/or flexion, in accordance with embodiments of the invention;

FIG. 10 provides a partial perspective view of one embodiment of a device for assisting with extension and/or flexion, in accordance with embodiments of the invention;

FIG. 11 provides a partial perspective view of one embodiment of a device for assisting with extension and/or flexion, in accordance with embodiments of the invention;

FIG. 12 provides a partial perspective view of one embodiment of a device for assisting with extension and/or flexion, in accordance with embodiments of the invention;

FIG. 13 provides a partial perspective view of one embodiment of a device for assisting with extension and/or flexion, in accordance with embodiments of the invention;

FIG. 14 provides a partial perspective view of one embodiment of a device for assisting with extension and/or flexion, in accordance with embodiments of the invention;

FIG. 15 provides a partial perspective view of one embodiment of a device for assisting with extension and/or flexion, in accordance with embodiments of the invention;

FIG. 16 provides a perspective view of one embodiment of a device for assisting with extension and/or flexion, in accordance with embodiments of the invention; and FIG. 17 provides a perspective view of one embodiment of a device for assisting with extension and/or flexion, in accordance with embodiments of the invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Like numbers refer to like elements throughout.

Referring now to FIG. 1, a device for assisting in ankle support and range of motion 10 is illustrated according to one embodiment of the present invention. It should be noted that as used herein, the device for assisting in ankle support and range of motion 10 may be simply referred to as "the device".

The device 10 has a chair 12 in which a user sits and a movable foot manipulation assembly 14 to perform flexion and extension on the user's ankle. A knee support assembly 16 maintains position of the user's heel in order to prevent unwanted movement of the leg or heel during flexion and extension. The device 10 is operated by a power unit assemblyl 8 which causes the foot assembly 14 to pivot about an axis defined by the user's ankle. Collectively, the foot assembly 14, the knee support assembly 16, and the power unit assembly 18 may be referred to as "the major components" hereinafter.

An elongate adjustment main rail 20 extends outward and forward from the chair 12. The major components 14, 16, 18 are all movably connected to the main rail 20 such that each component is able to adjust for the user sitting in the chair 12 by moving closer to and further away from the user. In another alternative embodiment, the chair 12 may be movable while one or more of the major components 14, 16, 18 are fixed. In further embodiments, a bench or other seating or standing device is used instead of a chair.

As shown in FIGS. 2A and 2B, the main rail 20 has one end connected to the chair 12 and the other end resting on the floor, ultimately giving the main rail 20 a downward slope. Two brackets 26 having half-round openings 27 are connected to the main rail 20 on the end which connects to the chair 12. These half-round openings 27 are sized such that the brackets 26 can slide onto a chair cross-member 24. The half round openings allow the main rail 20 to pivot about the cross-member 24 so that the main rail 20 extends downward toward the floor on the end opposite to the bracket 26. This opposite end of the rail 20 has a rail end cap 28 and two end support bumpers 30 which make contact with the ground. Other suitable configurations are also envisioned such as a permanently attached assembly or a bench with specialized connections that can be compatible with the device 10 as well as other limb manipulation devices.

The main rail 20 is a t-slot aluminum extrusion with multiple channels, including side channels 22, and top/bottom channels 21. These channels 22, 21 enable the user to adjust the major components 14, 16, 18 along the length of the main rail 20. The major components 14, 16, 18 are configured to connect to one or more of the channels 22, 21. Adjustment is accomplished by sliding and then securing the major component 14, 16, 18 to desired positions.

As shown in FIG. 3, the power unit assembly 18 is connected to the main rail 20 by a bracket 32. The bracket 32 has a base 34, a side wall 36, an L member 38, and a retractable rail channel insert 40. A threaded knob 42 spans between the side wall 36 and the L member 38 such that the L member 38 is able to slide towards the side wall 36 and away from the side wall 36 when the threaded knob 42 is tightened or loosened. The retractable rail channel insert 40 is connected to the L member 38 and engages/disengages from the rail channel 22 when the threaded knob 42 is loosened or tightened. This enables the user, or a third party, to adjust the position of the power unit assembly 18 to a desired distance from the chair 12.

FIGS. 4A and 4B show the connection between the foot manipulation assembly 14 and the main rail 20. The foot manipulation assembly 14 is connected to the main rail 20 by a secondary rail 44 that movably connects to one side of the main rail 20. The secondary rail 44 has two elongate bearing pads 46 which span at least a portion of the secondary rail 44 length and engage with one of the side rail channels 22. Each bearing pad 46 has at least one carriage bolt 45 which allows the bearing pad 46 to slide along the main rail 20 without being pulled away from the main rail 20. The secondary rail 44 is able to slide to a desired position and/or be moved to an opposite side of the main rail 20 as necessary. In one embodiment the bearing pads 46 are made of plastic.

A foot manipulation assembly base plate 48 is connected to the secondary rail 44 by a double quick-release pin 50 which passes through the base plate 48 and the secondary rail 44 by aligning two pairs of holes. The double pin 50 prevents the base plate 48 from rotating relative to the secondary rail 44 during operation of the device 10. The base plate 48 spans perpendicular to both rails 20, 44 and enables the foot engagement components of the foot manipulation assembly 14 to be centered with respect to the main rail 20. A star knob 49 having a carriage bolt (not shown) passes through the base plate 48 and is attached to one of the top channels 21, preferably the middle top channel 21. Loosening the knob 49 enables the foot manipulation assembly 14 to be moved along the main rail 20 and tightening the knob 49 fixes the position of the foot manipulation assembly 14. This positioning may be to accommodate for the user's leg length or to switch between stretching with an extended or straight knee.

The knee support assembly 16 connection to the main rail 20 is shown in FIGS. 5A and 5B. A first bearing pad 52 is connected to an underside support member 56. The underside support member 56 has a second bearing pad 53 which engages with one of the bottom channels 21 in the main rail 20. A third bearing pad 54 is connected to the first bearing pad 52 and positioned to allow engagement with one of the side channels 22 in the main rail 20. A carriage bolt 55 connected to a knob 128 passes through the third bearing pad 54 and into the channel 22. The carriage bolt 55 may be loosened to move the knee support assembly 16 to a desired position along the main rail 20 or tightened to generate friction and secure the knee support assembly 16 to the main rail 20.

FIGS. 6 and 7 show the power unit assembly 18 and the foot manipulation assembly 14. Operation of the device 10 begins with the user moving a manual pumping lever 58 which, in turn, causes a foot plate 60 to pivot and provide flexion and extension assistance to the user's ankle. Mechanical energy of the user pumping the lever 58 is converted to hydraulic energy which moves the foot plate 60.

The user grips a lever handle 62 to manually pump the lever 58 in a forward and backward reciprocating motion. A pivoting bracket 64 is positioned at the end of the lever 58 opposite the handle 62. Each motion of the lever 58 results in the pivoting bracket 64 pivoting about a fulcrum 66. A small cylinder (a.k.a. "power cylinder") 68 is connected to the bracket 64 such that the reciprocating motion of the lever 58 pivots the bracket 64 about the fulcrum 66 and actuates the power cylinder 68.

The user grips a lever handle 62 to manually pump the lever 58 in a forward and backward reciprocating motion. A pivoting bracket 64 positioned at the end of the lever 58 opposite the handle 62. Each motion of the lever 58 results in the pivoting bracket 64 to pivot about a fulcrum 66. A small cylinder (a.k.a. "power cylinder") 68 is connected to the bracket 64 such that the reciprocating motion of the lever 58 pivots the bracket 64 about the fulcrum 66 and actuates the power cylinder 68.

Actuation of the power cylinder 68 is accomplished by a power cylinder barrel 70 reciprocating in a relatively up and down motion on a stationary power cylinder piston rod 72. A chamber within the barrel 70 increases and decreases in size as the barrel 70 moves up and down with respect to the stationary piston rod 72. This causes hydraulic pressure of the fluid within the chamber to increase or decrease. Plumbing connectors 74, 76 enable the fluid pressure to pass between the chamber within the power cylinder 68 and a reservoir 78 through plumbing (not shown).

Fluid pressure is then transferred to a second, main cylinder (a.k.a "working cylinder") 80. Additional plumbing (not shown) enables fluid pressure to pass between the working cylinder 80 and a plumbing connector 82 of the reservoir 78. A working cylinder barrel 84 is mounted onto the secondary rail 44 and remains stationary while a working cylinder piston rod 86 reciprocates based on the fluid pressure within the chamber between the barrel 84 and the piston rod 86. The piston rod 86 is connected to the footplate 60 such that the reciprocating movement of the piston rod 86 causes the footplate 60 to move.

A directional switch 88 is positioned on top of the reservoir 76. The user is able to adjust this switch 88 to perform flexion or extension of the ankle based on the switch 88 setting. Resulting movement of the user's foot may be incremental based on the pumping of the lever 58. For example, if the switch 88 is set for flexion, each pump of the lever 58 will cause the footplate 60 to incrementally rotate the user's foot toward the user, thus performing flexion on the user's ankle. Each pump of the lever 58 causes an additional incremental rotation of the foot until the desired amount of flexion (or extension for other examples) is achieved.

In addition to the previously described power unit assembly 18, the flexion or extension assistance may be performed by electric motor drive systems, mechanical driven systems (such as gear based), or other suitable systems. The power unit assembly 18 may also have other configurations which achieve the same end result of providing movement to the footplate 60.

The foot manipulation assembly 14 is best shown in FIGS. 8 and 9. Left and right upright brackets 90, 92 are mounted on opposing sides of the foot manipulation assembly base 48. The upright brackets 90, 92 are spaced-apart sufficiently such that the footplate 60 and the other components that enable the footplate 60 to pivot are all positioned between the upright brackets 90, 92. A left pivoting member 94 is rotatably connected to the top of the left upright bracket 90 and a right pivoting member 96 is rotatably connected to the top of the right upright bracket 92. The two pivoting members 94, 96 are able to rotate about an axis of rotation 98 which corresponds to the axis of rotation of the user's ankle when the user's foot is positioned on the footplate 60.

The right pivoting member 96 has a bent, elbow-like, shape where two legs 100, 102, extend from a center fulcrum 104. One leg 100 is connected to the working cylinder piston rod 86 such that when the working cylinder piston rod 86 moves, the right pivoting member 96 rotates about the fulcrum 104. The other leg 102 and the left pivoting member 94 extend parallel to each other with a footplate mounting base 106 spanning between. The footplate 60 is mounted in the middle of the footplate mounting base 106. The footplate mounting base 106 and the footplate 60 are mounted with an angle such that the foot is able to rest on the footplate 60. The footplate 60 has a heel rest 112 that may be adjustable to accommodate different users. This footplate mounting base 106 is connected to the pivoting members 94, 96 by movable fasteners 108, 110. These fasteners 108, 110 are able to move along the length of the pivoting members 94, 96 in order to adjust for different users.

As shown in FIG. 10, the two pivoting members 94, 96, the footplate mounting base 106, and the footplate 60 are all able to swing, or pivot, as one unit about the axis of rotation 98. Extension and retraction of the working cylinder piston rod 86 causes the entire unit to pivot and perform flexion or extension of the user's ankle in incremental mounts for each extension or retraction movement of the working cylinder piston 86.

The knee support 16, shown in FIG. 11, includes a pad 114 for holding the knee in position and a telescoping rod 116. The telescoping rod has a top inner tubing 118, a lower outer housing tube 120, and a one way roller lock 122 connecting the inner tubing 118 to the lower tubing 120. The one way roller lock 122 allows the inner tubing 118 to slide upwards while preventing downward sliding once the desired height is reached. This height adjustment is shown by arrows in FIG. 12. Other mechanisms for adjusting the height of the knee support 16 are also envisioned such as threaded knobs and hole and pegs.

The pad 114 is attached to the inner tubing 118 and has a dumbbell shape. The pad 114 is intended to rest at the top of the knee or the lower thigh. The knee support 16 holds the user's knee/upper thigh area in position so that the user's foot and heel stay on the footplate 60 during operation of the device 10.

As best shown in FIG. 13, an adjustment plate 124 has a telescoping rod bracket 125 for holding the telescoping rod 116 and a curved adjustment slot 126 which the threaded knob 128 passes through. The adjustment plate 124 is rotatably connected to a spacer block 130 such that when the threaded knob 128 is loosened, the adjustment plate 124 may rotate along the curved adjustment slot 126. In one embodiment the spacer block 130 is plastic. Once the desired position is reached, the threaded knob 128 may be secured into place. This adjustment enables the user to adjust the angle of the telescoping rod 116 as indicated by arrows in FIG. 12.

FIG. 14 shows another embodiment of a foot manipulation assembly 200 where an air bag 202 is utilized to hold the user's foot onto a footplate 204. The airbag 202 is held in place by a curved member 206 which allows the air bag 202, when inflated, to apply pressure onto the user's foot. The air bag 202 is inflated and deflated manually by a hand operated pump 208 connected to the air bag 202 by a conduit 210. Other pumps, such as foot operated pumps, are also envisioned.

The footplate 204 is able to pivot, or swing, on a frame 214 about an axis of rotation 212 which corresponds to the axis of rotation of the user's ankle. A central force application bar 216 is connected on one end to a working cylinder 218 and to the footplate 204 on the other end. As the working cylinder 218 extends and retracts the central force application bar 216 the footplate 204 swings about the axis 212 to provide flexion or extension to the user's ankle.

In order to maintain position of the user's leg and knee, a knee support assembly 300 provides a knee pad 302 upon which the user rests the underside of the knee or the upper leg when the user is sitting in a chair 304. This knee support assembly 300 is shown in FIG. 15. The knee pad 302 is mounted on two upright supports 306 which are able to adjust height wise by sliding up and down in brackets 308. Threaded knobs 310 then secure the upright supports 306 in place. The brackets 308 are mounted on a knee support assembly base 312 which is able to adjust along the length of a rail 314 by loosening and tightening one or more threaded knobs 316.

A measuring guide rule 318 may be installed on, or formed into the rail 314 in order to more accurately replicate measurements for users. Rulers, or other guide markings, may be included on any of the aforementioned embodiments on any of the components for improved repeated adjustability.

Referring now to FIGS. 16 and 17, a device for assisting in ankle support and range of motion 400 is shown. In this embodiment, the device 400 is capable of being disassembled and reassembled for storage and transport. The device 400 has a chair 402 and an elongate adjustment main rail 410 extending forward from the chair 402. As in the other embodiments, the device 400 has a foot manipulation assembly 404, a knee support assembly 406, and a power unit assembly 408 which are movably attached to the main rail 410.

The foot manipulation assembly 404 is able to disassemble and fold by removing two release pins 424 on a left upright bracket 426 and a right upright bracket 434. Removing the release pins 424 enables the foot manipulation assembly 404 to rotate about a shoulder bolt 430 and fold into a more compact configuration. Reassembly is achieved by unfolding the foot manipulation assembly 404 and inserting the release pins 424.

A main working cylinder 414 of the foot manipulation assembly 404 may be released from the device 400 by a quick release pin 412 installed at a rear pivot point of the working cylinder 414 and a flat-headed quick release pin 416 installed in a recessed hole of a right pivoting arm 418. Folding of the foot manipulation assembly 404 and removal of the working cylinder 414 enable the device 400 to be packaged for storage and transport.

In this embodiment the foot manipulation assembly is also secured to the main rail 410 with a L-handle brake 420 mounted on a secondary rail 422. The L-handle brake 420 is connected to a carriage bolt (not shown) that passes through the secondary rail 422 and slides into a channel of the main rail 420. Operation of the L-handle brake 420 tightens or loosens the secondary rail 422 with respect to the main rail 420.

As a precaution against damaging the working cylinder 414, an angle plate 432 may be installed on the right upright bracket 434. The angle plate 432 prevents the pivoting arm from pivoting the working cylinder 414 upwards when the working cylinder 414 is a retracted state.

Alternate embodiments of the invention may use one or more power unit assemblies that are or include a hydraulic system, a pneumatic system and/or an electro-mechanical system that may include geared mechanical system and/or a motor. Embodiments using a pneumatic system may use a cylinder and piston driven by pressurized air. Embodiments using an electro-mechanical system may be powered by standard 120V or 240V power supply that powers a motorized force application such as by driving one or more gears configured in a geared mechanical system for transferring force.

In various embodiments, the flexion functionality of the invention may be operated by a user submitting input to the system such as by pressing a button to actuate a motor or pumping a lever to actuate a mechanical system.

In various embodiments, the extension functionality of the invention may be operated by a user submitting input to the system such as by pressing a button to actuate a motor or pumping a lever to actuate a mechanical system.

In some embodiments, force feedback (or tactile sense of resistance) in the system can be felt by the user in a hydraulic system (i.e. the user feels that it is harder to pump the lever when there is more resistance due to a stiff knee or at the end of the range of motion). Other methods of simulating this feedback could be achieved in a mechanical system, hydraulic system, or via a motor (i.e. the motor can be programmed to move slower/faster based on measured torque). For example, in various embodiments of the invention, force feedback is provided to the user through touch, such as by resistance when the user is actuating either or both of the extension and flexion functionalities. For example, the system may provide force feedback to the user via a lever-driven input mechanism when the patient's anatomy is resisting the extension or flexion movements. Such force feedback through the user's input mechanism is important to avoid injury and ensure achievement of appropriate levels of high-intensity stretch while minimizing risk. In electro-mechanical driven systems that are part of alternate embodiments of the invention, the user may receive force feedback by varying levels of vibration of a button or other input device, varying levels of audible alerts, varying levels of visual alerts, or some combination of the same.

It should be noted that features in all embodiments previously discussed may be used in conjunction with or in place of features in all previous embodiments.

What is claimed is:

1. A device for manipulating a foot of a user, thereby providing extension or flexion assistance to an ankle of the user, the device comprising:

(a) a footplate positioned at a pre-determined distance from the user and configured to move around an axis of rotation substantially corresponding to an axis of rotation of the ankle as the foot extends or flexes about the ankle; and (b) a force application system comprising:

i. a force applicator connected to the footplate, and ii. a force application mechanism, wherein the force application mechanism is configured to apply a force to the force applicator, thereby providing the extension or flexion assistance to the foot about the ankle;

wherein a power unit is configured to provide power to the force application mechanism;

wherein the power unit includes:

(a) a lever adapted to move about a fulcrum;

(b) a hand grip positioned on an end of the lever opposite the fulcrum; and (c) whereby when the hand grip is moved by the user, the lever rotates about the fulcrum to generate power.

2. A device for manipulating a foot of a user, thereby providing extension or flexion assistance to an ankle of the user, the device comprising:

(a) a foot engagement assembly comprising:

i. a first frame positioned at a pre-determined distance from the user, and ii. a footplate connected to the first frame and configured to move around an axis of rotation substantially corresponding to an axis of rotation of the ankle as the foot extends or flexes about the ankle; and (b) a force application system comprising:

i. a force applicator connected to the foot engagement assembly, and ii. a force application mechanism, wherein the force application mechanism is configured to apply a force to the force applicator, thereby providing the extension or flexion assistance to the foot about the ankle;

wherein a power unit is configured to provide power to the force application mechanism;

wherein the power unit includes:

(a) a lever adapted to move about a fulcrum;
(b) a hand grip positioned on an end of the lever opposite the fulcrum; and
(c) whereby when the hand grip is moved by the user, the lever rotates about the fulcrum to generate power.

3. The device according to claim 2, wherein the force application mechanism is a hydraulic cylinder.

4. The device according to claim 2, wherein the force application mechanism is a mechanical driven system.

5. The device according to claim 2, wherein the power unit is a hydraulic cylinder.

6. The device according to claim 2, wherein the force application mechanism is powered by a hand pump adapted for use by an arm of the user.

7. The device according to claim 2, wherein the footplate is adapted to adjust to a pre-determined distance from the user.

8. The device according to claim 2, further comprising a knee engagement assembly adapted to engage an anterior of the user's knee or lower thigh and secure the user's foot on the footplate during extension or flexion assistance.

9. The device according to claim 8, wherein the knee engagement assembly includes a knee support having a padded portion for engaging the user's knee mounted on a telescoping member adapted to adjust for secured engagement of the user's knee.

10. The device according to claim 2, further comprising a switch connected to the force application system and adapted to alternate the force application system between providing flexion and extension assistance.

11. The device according to claim 2, wherein the footplate is connected to a second frame extending from an underside of a chair.

12. The device according to claim 11, wherein a knee support is connected to the second frame.

13. The device according to claim 11, wherein the force application system is connected to the second frame.

14. The device according to claim 2, further comprising an adjustment second frame extending from an underside of a chair.

15. The device according to claim 14, wherein the footplate, a knee support, and the force application system are all adjustably connected to the second frame.

16. The device according to claim 2, further comprising an inflatable member positioned above the footplate and adapted to secure the user's foot to the footplate when the inflatable member is inflated.

17. The device according to claim 2, further comprising a knee support adapted to engage a posterior of the user's knee or lower thigh and maintain knee positioning during extension or flexion assistance.

18. A device for manipulating a foot of a user, thereby providing extension or flexion assistance to an ankle of the user, the device comprising:

(a) a foot engagement assembly comprising:
  i. a frame positioned at a pre-determined distance from the user, and
  ii. a footplate connected to the frame and configured to move around an axis of rotation substantially corresponding to an axis of rotation of the ankle as the foot extends or flexes about the ankle;
(b) a knee engagement assembly adapted to engage the user's knee and secure the user's foot on the footplate during extension or flexion; and
(c) a force application system comprising:
  i. a force applicator connected to the foot engagement assembly, and
  ii. a force application mechanism, wherein the force application mechanism is configured to apply a force to the force applicator, thereby providing the extension or flexion assistance to the foot about the ankle;
  wherein a power unit is configured to provide power to the force application mechanism;
  wherein the power unit includes:
    (a) a lever adapted to move about a fulcrum;
    (b) a hand grip positioned on an end of the lever opposite the fulcrum; and
    (c) whereby when the hand grip is moved by the user, the lever rotates about the fulcrum to generate power.

19. The device according to claim 18, further comprising an adjustment rail adapted to enable the foot engagement assembly, knee engagement assembly, and force application system to adjust to pre-determined distances from the user's position.

* * * * *